United States Patent [19]

Yamanouchi et al.

[11] Patent Number: 4,721,666

[45] Date of Patent: Jan. 26, 1988

[54] PHOTOGRAPHIC ELEMENT

[75] Inventors: Junichi Yamanouchi; Masaharu Toriuchi, both of Kanagawa, Japan

[73] Assignee: Fuji Photo Film Co., Ltd., Kanagawa, Japan

[21] Appl. No.: 894,544

[22] Filed: Aug. 8, 1986

[30] Foreign Application Priority Data

Aug. 8, 1985 [JP] Japan ..... 60-174734

[51] Int. Cl.[4] ..... G03C 5/54; G03C 1/84

[52] U.S. Cl. ..... 430/213; 430/518; 430/941; 526/260; 526/263; 526/310

[58] Field of Search ..... 430/213, 518, 941; 526/310, 260, 263; 428/521

[56] References Cited

U.S. PATENT DOCUMENTS

| | | | |
|---|---|---|---|
| 3,958,995 | 5/1976 | Campbell et al. | 430/213 |
| 4,131,469 | 12/1978 | Miyazako et al. | 430/213 |
| 4,147,548 | 4/1979 | Karino et al. | 430/213 |
| 4,463,080 | 7/1984 | Snow et al. | 430/213 |
| 4,596,756 | 6/1986 | Yamanouchi et al. | 430/213 |

*Primary Examiner*—Richard L. Schilling
*Attorney, Agent, or Firm*—Sughrue, Mion, Zinn, Macpeak & Seas

[57] ABSTRACT

A photographic element comprising at least one layer containing a polymeric mordant represented by formula (I)

(I)

wherein

A represents a repeating unit derived from a copolymerizable monomer having at least two ethylenically unsaturated groups;

B represents a repeating unit derived from a copolymerizable ethylenically unsaturated monomer other than the repeating unit of A and the repeating unit having the copolymerization ratio of z;

$R^1$ represents a hydrogen atom or a lower alkyl group;

$R^2$, $R^3$, and $R^4$ each represents an unsubstituted or substituted alkyl or aralkyl group, or two or more of $R^2$, $R^3$, and $R^4$ are bonded to form a cyclic structure together with the adjacent nitrogen atom, and the total number of carbon atoms of $R^2$, $R^3$, and $R^4$ is 12 or more;

$R^5$ represents an unsubstituted or substituted alkyl, alkoxy, or acylamino group having 1 to 20 carbon atoms, or a halogen atom;

m is 0, 1 or 2, and n is an integer of from 1 to 12;

$X^{\ominus}$ represents an anion; and x is from 30 to 80 mol %, y is from 0 to 60 mol %, and z is from 10 to 70 mol %.

18 Claims, No Drawings

PHOTOGRAPHIC ELEMENT

FIELD OF THE INVENTION

The present invention relates to new polymers which are good mordants for photographic dyes as well, and to photographic elements containing polymers of this kind.

BACKGROUND OF THE INVENTION

In the technical field of photography, it is well known to use various kinds of polymers as a mordant for the purpose of preventing undesired migration of dyes. U.S. Pat. Nos. 4,131,469, 4,147,548 and 4,308,335, German Patent Application (OLS) No. 2,941,818 and Japanes Patent Application (OPI) Nos. 30328/78 and 17352/81 (the term "OPI" as used herein refers to a "published unexamined Japanese patent application") disclose polymeric mordants.

In addition, British Pat. Nos. 2,011,912 and 2,093,041 and U.S. Pat. No. 4,282,305 disclose polymer mordants which exhibit less chemical change or decomposition of dye images under irradiation by light. However, these polymer mordants are poor in the mordantability, and, therefore, the time to be required for the transfer of dyes is extremely long, which is a very serious defect in the application of the polymer mordants to the field of instant color photography. Further, dyes are apt to be desorbed and are diffused because of the somewhat poor mordantability of the polymer mordants, resulting in poor sharpness of images; this is another defect.

On the other hand, U.S. Pat. No. 3,898,088 described water-insoluble mordants containing a quaternary nitrogen atom having a substituent with a large number of carbon atoms; and U.S. Pat. Nos. 3,958,995 and 4,193,800 describe polymer latex mordants which are insolublized in water. These mordants have higher dye retentivity when they contain a quaternary nitrogen atom having a substituent with a larger number of carbon atoms, and further, the diffusion of dyes is less in such a case.

However, it has been found that the color images as mordanted with mordants of these kinds become cloudy if the water derived from a treating solution is not completely dried (i.e., in a so-called wet state) with the results of a lowering of the density of the color images and the occurrence of blur. In other words, the image quality of the color images becomes poor, for example, as if pictures are looked at through a ground glass. This phenomenon is especially remarkable in integral imaging receiver type photographic elements of low drying speed and becomes more pronounced within about two weeks after the photographic image is formed, and this is a fatal defect in an instant color photography which is characterized by the high rapidity of the formation of images.

It is noted that the cloud in a wet state is apt to be higher in the case of the use of mordants of higher color retentivity (mordantability), and therefore, the use of a strong mordant which contains a quaternary nitrogen atom having a substituent with a large number of carbon atoms results in a reciprocal relationship between the mordanting ability of the mordant and the cloud of the image formed. In order to obtain photographic materials capable of forming images of high sharpness and resolving power, it is essential that the mordants to be used in the materials are to have high mordanting ability, and therefore, it has heretofore been strongly desired to solve the problem of the aforementioned reciprocal relationship.

SUMMARY OF THE INVENTION

A first object of the present invention is to provide polymeric mordants which have extremely excellent mordantability and which are effective for the formation of images with no cloud in a wet state, and photographic elements containing them.

A second object of the present invention is to provide photographic elements for color diffusion transfer processes, which have high dye retentivity and which can form images of high sharpness.

A third object of the present invention is to provide photographic elements for color diffusion transfer processes, which can form dye-transferred images in a short period of time after photographic exposure.

The present inventors have found, as a result of extensive research efforts, that the above first object is effectively attained by the provision of a photographic element containing a polymeric mordant represented by formula (I) below, especially a photographic element comprising at least one layer containing said polymeric mordant. The above second and third objects are effectively attained by the provision of a photographic element comprising a support having provided thereon at least one light-sensitive silver halide emulsion layer and at least one layer containing said polymeric mordant.

The polymeric mordant according to the invention is represented by formula (I)

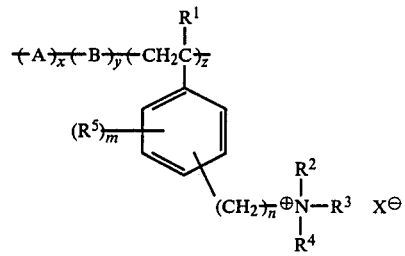

(I)

wherein

A represents a repeating unit as derived from a copolymerizable monomer having at least two ethylenically unsaturated groups;

B represents a repeating unit as derived from a copolymerizable ethylenically unsaturated monomer other than the repeating unit of A and the repeating unit having the copolymerization range of z;

$R^1$ represents a hydrogen atom or a lower alkyl group;

$R^2$, $R^3$ and $R^4$ (which may be the same or different) each represents an unsubstituted or substituted alkyl or aralkyl group; or two or more of $R^2$, $R^3$ and $R^4$ are bonded to form a cyclic structure together with the adjacent nitrogen atom; the total number of carbon atoms of $R^2$, $R^3$ and $R^4$ is 12 or more;

$R^5$ represents an unsubstituted or substituted alkyl, alkoxy, or acylamino group having from 1 to 20 carbon atoms, or a halogen atom;

m is 0, 1 or 2; n is an integer of from 1 to about 12;

$X^{\ominus}$ represents an anion; and x is 30 to 80 mol%, y is 0 to 60 mol%, and Z is 10 to 70 mol%.

DETAILED DESCRIPTION OF THE INVENTION

The compounds represented by formula (I) according to the present invention are explained in greater detail hereinafter.

Examples of the copolymerizable monomers having at least two ethylenically unsaturated groups that can be used to form the repeating unit represented by A include divinylbenzene, ethylene glycol dimethacrylate, isopropylene glycol dimethacrylate, neopentyl glycol dimethacrylate, tetramethylene glycol diacrylate, tetramethylene glycol dimethacrylate, etc.; and divinylbenzene and ethylene glycol dimethacrylate are especially preferred among them.

B represents a repeating unit derived from a copolymerizable ethylenically unsaturated monomer, and examples of the ethylenically unsaturated monomers include ethylene, propylene, 1-butene, isobutene, styrene, α-methylstyrene, vinyltoluene, monoethylenically unsaturated esters of fatty acids (such as vinyl acetate, allyl acetate), ethylenically unsaturated monocarboxylates or dicarboxylates (such as methyl methacrylate, ethyl acrylate, n-butyl acrylate, n-butyl methyacrylate, n-hexyl methacrylate, n-octyl acrylate, benzyl acrylate, cyclohexyl methacrylate, 2-ethylhexyl acrylate), monoethylenically unsaturated compounds (such as acrylonitrile, methacrylonitrile), dienes (such as butadiene, isoprene), etc.; and styrene, methyl methacrylate and acrylonitrile are especially preferred among them.

B may contain two or more kinds of these monomer units.

$R^1$ represents a hydrogen atom or a lower alkyl group, preferably a halogen atom or a lower alkyl group having from 1 to 6 carbon atoms (for example, a methyl group, an ethyl group, an n-propyl group, an n-butyl group, an n-amyl group, or an n-hexyl group); and is especially preferably a hydrogen atom or a methyl group.

$R^2$, $R^3$, and $R^4$ (which may be the same or different) each represents an unsubstituted or substituted alkyl group, preferably having from 1 to about 20 carbon atoms, or an unsubstituted or substituted aralkyl group, preferably having from 7 to about 20 carbon atoms.

Two or more of $R^2$, $R^3$, and $R^4$ may be bonded to form a cyclic structure together with the adjacent nitrogen atom. The total number of carbon atoms of $R^2$, $R^3$ and $R^4$ is 12 or more.

Examples of the unsubstituted alkyl group include a methyl group, an ethyl group, an n-propyl group, an isopropyl group, an n-butyl group, an isobutyl group, a t-butyl group, an n-amyl group, an isoamyl group, an n-hexyl group, a cyclohexyl group, an n-heptyl group, an n-octyl group, a 2-ethylhexyl group, an n-nonyl group, an n-decyl group, an n-dodecyl group, etc.; and the number of carbon atoms in these unsubstituted alkyl groups is preferably from 1 to 10.

Examples of the substituted alkyl group include an alkoxyalkyl group (such as a methoxymethyl group, a methoxyethyl group, a methoxybutyl group, an ethoxyethyl group, an ethoxypropyl group, an ethoxybutyl group, a butoxyethyl group, a butoxypropyl group, a butoxybutyl group, a vinyloxyethyl group), a cyanoalkyl group (such as a 2-cyanoethyl group, a 3-cyanopropyl group, a 4-cyanobutyl group), a halogenated alkyl group (such as a 2-fluoroethyl group, a 2-chloroethyl group, a 3-fluoropropyl group), an alkoxycarbonylalkyl group (such as an ethoxycarbonylmethyl group), an allyl group, a 2-butenyl group and a propargyl group, and the number of carbon atoms in the substituted alkyl group is preferably from 1 to 12.

The aralkyl group includes an unsubstituted aralkyl group and a substituted aralkyl group. Examples of the unsubstituted aralkyl groups are a benzyl group, a phenethyl group, a diphenylmethyl group and a naphthylmethyl group; and examples of the substituted aralkyl groups are an alkylaralkyl group (such as a 4-methylbenzyl group, a 2,5-dimethylbenzyl group, a 4-isopropylbenzyl group), an alkoxyaralkyl group (such as a 4-methoxybenzyl group, a 4-ethoxybenzyl group, a 4-(4-methoxyphenyl)benzyl group), a cyanoaralkyl group (such as a 4-cyanobenzyl group, a 4-(4-cyanophenyl)benzyl group), a perfluoroalkoxyaralkyl group (such as a 4-pentafluoropropoxybenzyl group, a 4-undecafluorohexyloxybenzyl group), a halogenated aralkyl group (such as a 4-chlorobenzyl group, a 4-bromobenzyl group, a 3-chlorobenzyl group, a 4-(4-chlorophenyl)benzyl group, a 4-(4-bromophenyl)benzyl group), etc. The number of carbon atoms in these unsubstituted or substituted aralkyl groups is preferably from 7 to 14.

Two or more of $R^2$, $R^3$, and $R^4$ may be bonded to form a cyclic structure together with the adjacent nitrogen atom, and examples thereof include the formulae

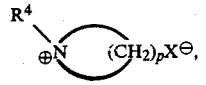

in which p is an integer of from 4 to 12, and $R^4$ and $X^{\ominus}$ have the same meanings as above, and

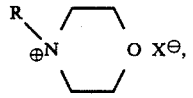

in which $R^4$ and $X^{\ominus}$ have the same meanings as above.

$R^5$ represents an alkyl, substituted alkyl, alkoxy or acylamino group having from 1 to 20 carbon atoms or a halogen atom (such as a chlorine atom). Examples of the alkyl groups and substituted alkyl groups include those described above for $R^2$, $R^3$ and $R^4$.

Preferable examples of the alkoxy groups of $R^5$ are a methoxy group, an ethoxy group, a butoxy group, a hexyloxy group, an octyloxy group, and a benzyloxy group; and preferable examples of the acylamino groups are an acetamido group, a propionamido group and a benzamido group.

m is 0, 1 or 2; n is an integer of from 1 to about 12. Preferably, m is 0 and n is 1.

$X^{\ominus}$ represents an anion, for example, a halogen ion (such as a chloride ion, a bromide ion, an iodide ion), an alkylsulfuric acid ion (such as a methylsulfuric acid ion, an ethylsulfuric acid ion), an alkyl- or arylsulfonic acid ion (such as a methanesulfuric acid, an ethanesulfonic acid, a benzenesulfonic acid or a p-toluenesulfonic acid ion), an acetic acid ion or a sulfuric acid ion. Chloride ion is especially preferred.

x is 30 to 80 mol%, preferably 30 to 70 mol%; y is 0 to 60 mol%, preferably 0 to 30 mol%; and z is 10 to 70 mol%, preferably 30 to 70 mol%.

One preferred method for the synthesis of the compounds of formula (I) of the present invention is to utilize compounds represented by formula (II)

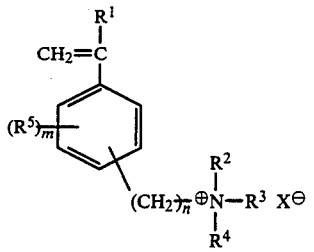

(II)

wherein $R^1$, $R^2$, $R^3$, $R^4$, $R^5$, m, n, and $X^{\ominus}$ have the same meanings as in formula (I) above.

If the compounds of formula (II) to be used are insoluble in water, the above-described copolymerizable monomer having at least two ethylenically unsaturated groups, the above-described ethylenically unsaturated monomer and the compound of formula (II) are copolymerized by emulsion polymerization to obtain the compounds of formula (I). Of the compounds of formula (II), the "water-insoluble" compounds include those which do not dissolve in water to the amount of 5 g or more per 100 g of water.

On the other hand, if the compounds of formula (II) to be used are soluble in water, a solution of the monomers (in the case when the monomers are imcompatible and insoluble each other, an auxiliary solvent such as water, alcohol or acetone may be used) and a polymerization initiator are simultaneously added to a hot water for the copolymerization of the monomers to obtain the compounds of formula (I). In this case, the polymerization temperature may be from 50° to 100° C., and is more preferably from 80° to 100° C., to obtain preferable polymer dispersions.

The above-described emulsion polymerization may be carried out, in general, in the presence of at least one surfactant selected from nonionic surfactants (such as polyvinyl alcohol, polyoxyethylene nonylphenyl ether) and cationic surfactants (such as cetyl trimethylammonium chloride), and a radical initiator (for example, combination of potassium persulfate and sodium sulfite).

Another method for the formation of the polymeric mordants according to formula (I) of the present invention is to copolymerize the above-described copolymerizable monomer having at least two ethylenically unsaturated groups, the above-described ethylenically unsaturated monomer and an unsaturated monomer represented by the following formula (III) (such as chloromethylstyrene) by emulsion polymerization, and then to quaternize the resulting copolymer with a tertiary amine having a structure of

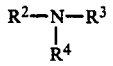

(in which $R^2$, $R^3$ and $R^4$ have the same meanings as above) (such as tri-n-butylamine, tri-n-pentylamine or tri-n-hexylamine), to obtain the compound of formula (I).

The unsaturated monomer represented by formula (III) is

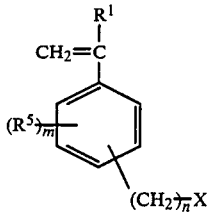

(III)

wherein $R^1$, $R^5$, X, m and n have the same meanings as above.

Still another method for the formation of the polymeric mordants according to formula (I) of the present invention is to copolymerize the above-described copolymerizable monomer having at least two ethylenically unsaturated groups, the above-described ethylenically unsaturated monomer and unsaturated monomer represented by the following formula (IV) (such as 4-(N,N-dimethylaminoethyl)styrene or 4-(N,N-diethylaminoethyl)styrene) by emulsion polymerization and then to quaternize the resulting copolymer with an alkylating agent or aralkylating agent having a structure of $R^4$—X (in which $R^4$ and X have the same meanings as above), to obtain the compound of formula (I).

The unsaturated monomer represented by formula (IV) is

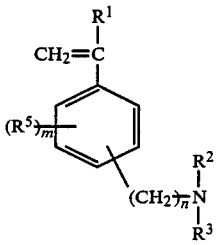

(IV)

wherein $R^1$, $R^2$, $R^3$, $R^5$, m and n have the same meanings as above. Examples of the alkylating agents which may be used are methyl p-toluenesulfonate, dimethyl sulfate, diethyl sulfate, ethyl bromide, n-propyl bromide, allyl chloride, n-butyl bromide, chloro-2-butene, ethyl chloroacetate, n-hexyl bromide and n-octyl bromide; and examples of the aralkylating agents are benzyl chloride, benzyl bromide, p-nitrobenzyl chloride, p-chlorobenzyl chloride, p-methylbenzyl chloride, p-isopropylbenzyl chloride, dimethylbenzyl chloride, p-methoxybenzyl chloride, p-pentafluoropropenyloxybenzyl chloride, naphthyl chloride or diphenylmethyl chloride, and in particular, methyl p-toluenesulfonate, dimethyl sulfate, diethyl sulfate and benzyl chloride are especially preferred among them.

The above-described emulsion polymerization may be carried out, in general, in the presence of at least one surfactant selected from anionic surfactants (such as Triton-770, which is a commercial product of Rhom & Haas Co.), cationic surfactants (such as cetyl trimethylammonium chloride, stearyl trimethylammonium chloride) and nonionic surfactants (such as polyvinyl alcohol), and a radical initiator (such as combination of potassium persulfate and potassium hydrobenbisulfite).

The above-described quaternization reaction may be carried out, in general, at from about 0° C. to about 100° C., and especially preferably from 40° C. to 70° C.

Examples of the polymeric mordants of the present invention are set forth below, which, however, are not whatsoever limitative. In the following formulae, the relative values for each of x, y and z indicate the molar ratio.
(1)
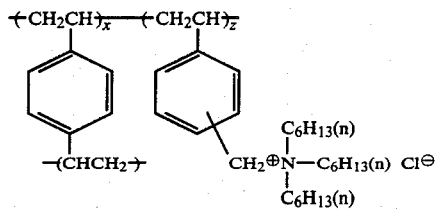
x/z = 40/60
(2)
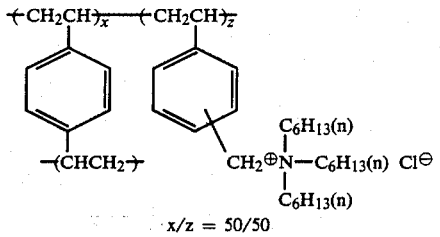
x/z = 50/50
(3)
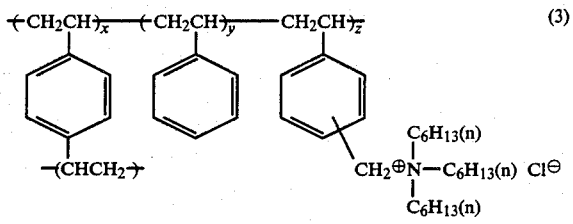
x/y/z = 40/30/30
(4)
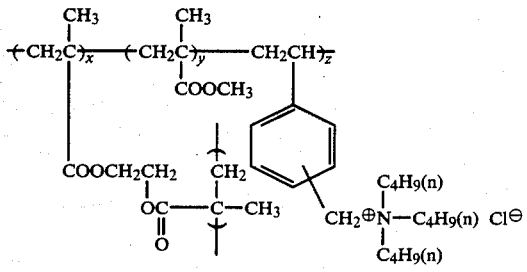
x/y/z = 30/30/40
(5)
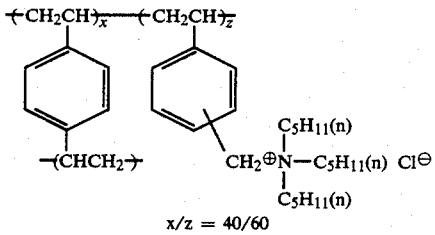
x/z = 40/60
(6)
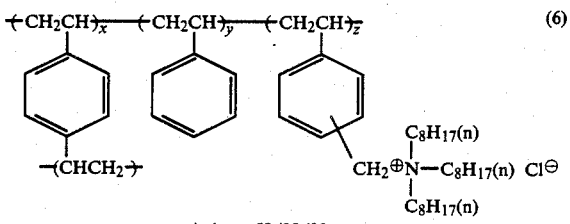
x/y/z = 50/20/30
-continued
(7)
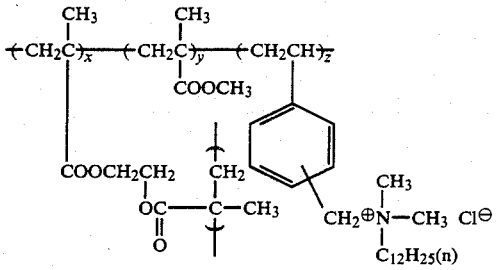
x/y/z = 40/30/30
(8)
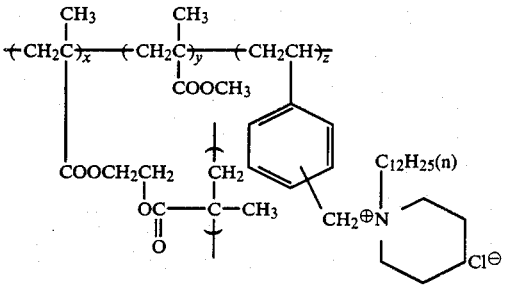
x/y/z = 30/30/40
(9)
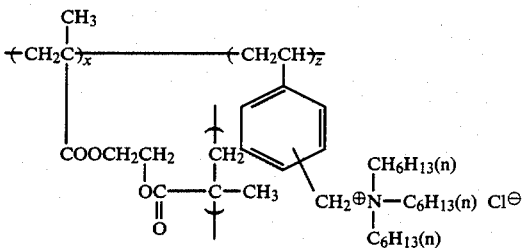
x/z = 50/50
(10)
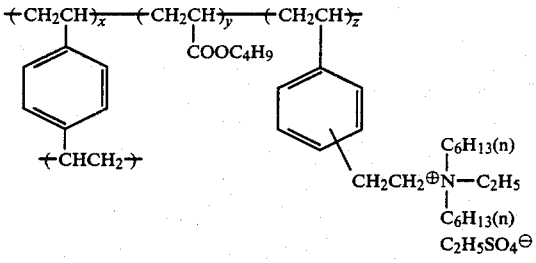
x/y/z = 40/30/30
(11)
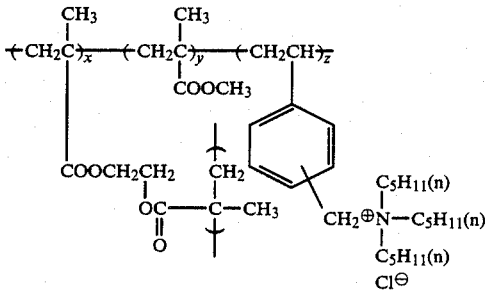
x/y/z = 35/25/40

-continued (12)

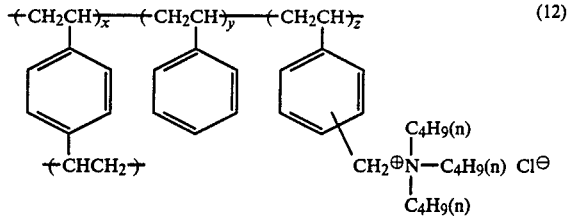

x/y/z = 30/30/40

(13)

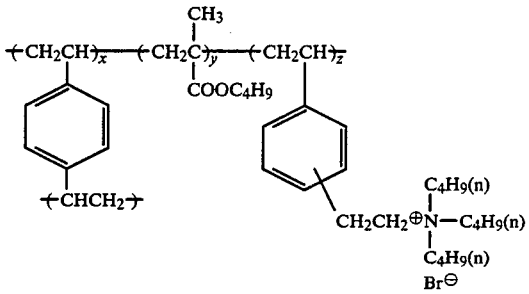

x/y/z = 40/20/40

(14)

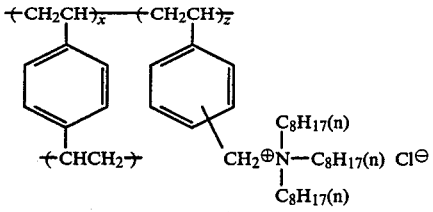

x/z = 65/35

(15)

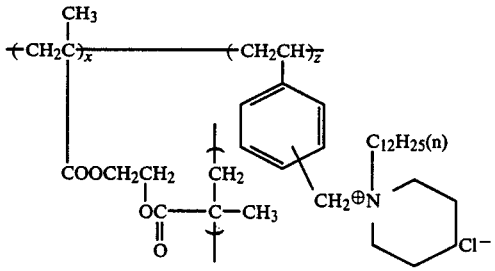

x/z = 50/50

(16)

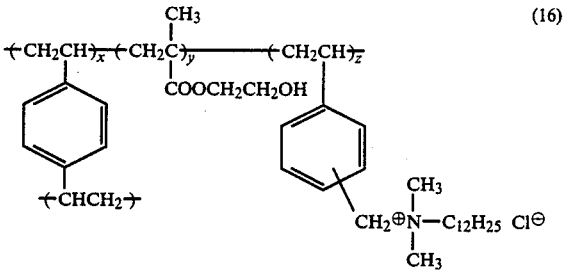

x/y/z = 30/30/40

The polymeric mordants of the present invention may be used as mordants for a color diffusion transfer process or as mordants for heat development type photographic materials, and, in addition, may also be used as mordants for dyes in an antihalation layer as described in U.S. Pat. No. 3,282,699.

The polymeric mordant layer of the present invention may form a film comprising only the polymer, or may additionally contain a natural or synthetic hydrophilic polymer of a type which is generally used in the field of photography (such as gelatin, polyvinyl alcohol or polyvinyl pyrrolidone, preferably polyvinyl alcohol). In addition, the polymeric mordants of the present invention may be incorporated in one or more layers in the form of a combination of two or more of the mordants (for example, a combination of a polymeric mordant and a polymer dispersion mordant), or may be incorporated in the same layer in the form of a mixture with some other mordant(s), or may be incorporated in plural different layers in the same photographic element. Further, the polymeric mordants of the present invention may be used in an excess dye-trapping mordant layer as described in U.S. Pat. No. 3,930,864. Other mordants which may be coused together with the polymeric mordants of the present invention include, for example those described in U.S. Pat. Nos. 4,131,469 and 4,147,548 and Japanese Patent Application (OPI) Nos. 136626/77, 126027/79 and 145529/79.

The optimum amount of the polymeric mordant to be used according to the present invention may easily be determined by those skilled in the art, in accordance with the amount of dye to be mordanted, the composition and the kind of the polymeric mordant being used, and the image formation process of the photographic material in which the mordant is used; and a generally useful range thereof may be from about 20 to 80% by weight based on the total amount of the mordant layer or from about 0.5 to 15 g/m$^2$ of the polymeric mordant, preferably from 40 to 60% by weight based on the total amount of the mordant layer of from 1 to 10 g/m$^2$ of the polymeric mordant.

The molymeric mordants of the present invention may be used in a color diffusion transfer process, and materials other than the present mordants, which are used together in such transfer process, are described hereinafter.

In the case that the polymeric mordant-containing photographic element forms a photographic film unit which is to be processed by passing through a pair of pressure parts as positioned in parallel, the unit generally comprises the following elements:

(1) Photographic light-sensitive element.

(2) Imare-receiving element containing the mordant of the present invention.

(3) Means capable of releasing an alkaline-treating composition in the inner part of the film unit made, for example, of a container capable of being broken under pressure, which optionally contains a silver halide developer.

(4) At least one support.

In one embodiment of a film unit as mentioned above, the photographic light-sensitive element comprising single or plural silver halide emulsion layers as coated on a support is, after exposure, adhered to the surface of the image-receiving element having at least one layer which contains the polymeric mordant of the present invention on a support, whereupon the surface of the exposed light-sensitive element faces the surface of the image-receiving element, and then an alkaline-treating composition is spread between the two elements, and thus the elements are processed. In the film unit of this kind, the both sides of the light-sensitive element of the film unit are preferably shielded from light, when taken out from a camera. In such an embodiment, the image-receiving element may be peeled off after the transfer, or the image formed may be without peeling off the element, as described, e.g., in U.S. Pat. No. 3,415,645.

In another embodiment, the support, the image-receiving element and the light-sensitive element are integrated into a combined (integral) unit. For example, it is effective for the formation of such integrated film unit to provide an image-receiving layer (containing the polymeric mordant of the present invention), a substantially opaque light-reflective layer (such as a lamination of a $TiO_2$ layer over a carbon black layer) and single of plural light-sensitive layers on a transparent support, e.g., as described in Belgian Pat. No. 755,960. After the light-sensitive layer is exposed, the film unit is adhered to an opaque cover sheet, face to face, and a treating composition is spread between them.

Still another embodiment of a type where the elements are adhered and integrated, to which the present invention may be adopted, is described in Belgian Pat. No. 757,959. In this embodiment, an image-receiving layer (containing the polymeric mordant of the present invention), a substantially opaque light-reflective layer (e.g., as described in the above) and single of plural light-sensitive layers are provided on a transparent support, and further, a transparent cover sheet is superposed thereon face to face. A container which may be broken under pressure and which may absorb an alkaline treating composition containing an opacifying agent (such as carbon black) is positioned adjacent to the uppermost layer of the above-described light-sensitive layer and the transparent cover sheet. This film unit is exposed through the transparent cover sheet, and when it is thereafter ejected from the camera, the container is broken by means of the pressure parts, whereby the treating composition (containing the opacifying agent) is spread between the light-sensitive layer and the cover sheet. Thus, the film unit is shielded from light and the development proceeds therein. In the photographic element of this kind, the light-sensitive element need not be integrated with the image-receiving element.

In the present invention, the color image providing substance to be used together with the silver halide emulsion layer is of negative type or positive type, and, when treated with an alkaline treating composition, this is initially movable or non-movable in the photographic element.

The negative type color image-forming compounds which may advantageously be used in the present invention are couplers which may form on release a dye by reaction with an oxidized color developer, and examples thereof are described, e.g., in U.S. Pat. No. 3,227,550 and Canadian Pat. No. 602,607. The other negative type color image-forming compounds which may preferably be used in the present invention are dye-releasing redox compounds which may release a dye by reaction with an oxidized developer or an electron transfer agent, and typical examples thereof are described, e.g., in U.S. Pat. Nos. 3,928,312, 4,135,929, 4,055,428, 4,336,322, 4,053,312, etc.

The non-movable positive type dye providing compounds which may be used in the present invention are those capable of releasing a diffusable dye without receiving electron (or not reduced) or after having received at least one electron (or reduced) in the photographic processing under an alkaline condition; and examples of these compounds are described in U.S. Pat. Nos. 4,199,354, 3,980,479, 4,199,355, 4,139,379, 4,139,389 and 4,232,107 and Japanese Patent Application (OPI) No. 69033/78.

In addition, positive type color image-providing compounds which are initially diffusible under an alkaline photographic processing condition are also useful in the photographic elements of the present invention. Dye developers are typical of these compounds, and examples thereof are described in U.S. Pat. Nos. 3,482,972, 3,880,658, etc.

The dyes as formed from the color image-providing compounds which are used in the present invention may be the dyes per se or may be dye precursors capable of being converted into the corresponding dyes in the photographic processing step or in any other additional processing step. In the initial stage of the photographic processing, the image dyes may be or may not be in the form of metal complexes. Typical dyes which are useful in the present invention are azo dyes, azomethine dyes, anthraquinone dyes and phthalocyanine dyes, which may or may not be in the form of metal complexes. In particular, cyan, magenta and yellow dyes are especially important among them.

Examples of yellow color image-forming compounds are described in U.S. Pat. Nos. 3,597,200, 3,309,199, 4,013,633, 4,245,028, 4,156,609, 4,139,383, 4,195,992, 4,148,641 and 4,148,643, Japanese Patent Application (OPI) Nos. 114930/76, 16130/81 and 71072/81, *Research Disclosure,* RD Nos. 17630 (1978) and 16475 (1977).

Examples of magenta color image-forming compounds are described in U.S. Pat. Nos. 3,453,107, 3,544,545, 3,932,380, 3,931,144, 3,932,308, 3,954,476, 4,233,237, 4,255,509, 4,250,246, 4,142,891, 4,207,104, 4,287,292 and 4,493,885, Japanese Patent Application (OPI) Nos. 106727/77, 23628/78, 36804/80, 73057/81 and 71060/81.

Examples of cyan color image-forming compounds are described in U.S. Pat. Nos. 3,482,972, 3,929,760, 4,013,635, 4,268,625, 4,171,220, 4,242,435, 4,142,891, 4,195,994, 4,147,544, 4,148,642 and 4,195,993, British Pat. No. 1,551,138, Japanese Patent Application (OPI) Nos. 99431/79, 8827/77, 47823/78, 143323/78, 99431/79 and 71061/81, European Pat. Nos. 53,037 and 53,040, *Research Disclosure,* RD No. 17630 (1978) and No. 16475 (1977).

In addition, dye-releasing redox compounds having a dye part whose adsorption spectrum is temporarily shifted in a light-sensitive element may be used in the present invention as the dye precursor. Examples of these compounds are described in U.S. Pat. Nos. 4,363,865, 4,310,612, T-999,003, 3,336,287, 3,579,334 and 3,982,946, British Pat. No. 1,467,317 and Japanese Patent Application (OPI) No. 158638/82.

The process for the formation of color images by color diffusion transfer by using the dye-releasing redox compounds is described in *Photographic Science and Engineering,* Vol. 20, No. 4, pp. 155–164 (July/August, 1976).

In the above color diffusion transfer process, any silver halide developer may be used which can oxidize the dye-releasing redox compounds by cross-oxidation. The developer may be incorporated in the alkaline processing composition or in an appropriate layer of the photographic element. Examples of the developers which may be used in the present invention are described below.

Hydroquinones, aminophenols, phenylenediamines, pyrazolidones (for example, phenidone, 1-phenyl-3-pyrazolidinone, dimezone (or 1-phenyl-4,4-dimethyl-3-pyrazolidinone), 1-p-tolyl-4-methyl-4-oxymethyl-3-pyrazolidinone, 1-(4'-methoxyphenyl)-4-methyl-4-oxymethyl-3-pyrazolidinone, 1-phenyl-4-methyl-4-oxymethyl-3-pyrazolidinone), as described in U.S. Pat. No. 4,336,322 and Japanese Patent Application (OPI) No. 16131/81.

In particular, black-and-white developers (especially pyrazolidinones) which have a capability of reducing the formation of stains in the image-receiving layer are more preferred than color developers such as phenylenediamines.

The treating composition to be used for the processing of the photographic elements of the present invention contains a base such as sodium hydroxide, potassium hydroxide, sodium carbonate, or sodium phosphate and is proper to have a pH value of about 9 or more and preferably has a pH value of 11.5 or more. The treating composition may contain an antioxidant such as sodium sulfite, ascorbic acid salt, or piperidinohexose reductone, and in addition, may further contain a silver ion concentration-regulating agent such as potassium bromide. In addition, the composition may optionally contain a thickening agent such as hydroxyethyl cellulose or sodium carboxymethyl cellulose.

Further, the alkaline treating composition may contain a compound having an activity capable of accelerating the development or accelerating the diffusion of dyes, such as benzyl alcohol.

The photographic elements of the present invention have a support which is free from extreme dimension change in the photographic processing. Examples of preferred supports are cellulose acetate films, polystyrene films, polyethylene terephthalate films, and polycarbonate films which are used in general photographic materials. In addition, papaer or laminate paper as formed by lamination of a water-impermeable polymer such as polyethylene on the surface may also effectively be used as the support of the present photographic materials.

The effects of the present invention are described below.

One characteristic feature of the present invention is that the dye is firmly fixed on the photographic element. That is, the time required for the appearance of images in the diffusion transfer photographic is short, and further, the sharpness of the color images formed is high, and the sharpness does not deteriorate to a perceptible extent even after preservation for a long period of time.

Another characteristic feature of the present invention is that the color images formed are not cloudy (in a wet state) when the polymeric mordant contained in the photographic element has such strong mordantability, as mentioned above, in accordance with the present invention.

Some examples for the synthesis of the polymeric moradants of the present invention are set forth below, which, however, do not whatsoever restrict the scope of the present invention.

SYNTHESIS EXAMPLE 1

(i) Synthesis of Quaternary Amine Monomer (N-vinylbenzyl-N,N,N-trihexylammonium chloride)

54.9 g (0.36 mol) of chloromethylstyrene, 80.7 g (0.30 mol) of tri-n-hexylamine, 0.5 g of nitrobenzene (as a polymerization inhibitor) and 400 ml of acetonitrile were put in a three-neck distillation flask having a capacity of 1 liter and heated for 7 hours under reflux, while stirring.

After being cooled to room temperature, the resulting solution was washed several times with 500 ml of n-hexane to remove the unreacted chloromethylstyrene. The crystals as precipitated after concentration were recrystallized with 500 ml of ethyl acetate to obtain 103.8 g of a desired produce of a white crystal of quaternary ammonium monomer. Yield: 82.1%

(ii) Polymer Dispersion

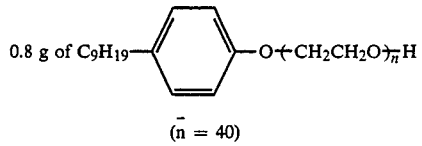

(surfactant, manufactured by Nippon Emulsion Co.), 12.7 g (0.03 mol) of the above-obtained quaternary amine monomer, 2.6 g (0.2 mol) of divinylbenzene and 130 ml of distilled water were placed in a three-neck distillation flask having a capacity of 300 ml and heated at 60° C. while stirring, whereupon a solution of 0.15 g of 2,2'-azobis(2-amidinipropane) hydrochloride (as a polymerization initiator) as dissolved in 10 ml of a degassed and distilled water was added thereto, and further heated at 60° C. for 5 hours while stirring. After being cooled to room temperature, the reaction mixture was filtered to obtain the desired Polymeric Mordant (1) as a dispersion.

SYNTHESIS EXAMPLES 2 TO 8

In an analogous manner to that of the above Synthesis Example 1, other Polymeric Mordants (2) to (8) were obtained. In addition, Polymeric Mordants (9) to (16) can be obtained analogously.

The present invention is explained in greater detail by reference to the following example, which is not intended as limiting the scope of the present invention.

EXAMPLE

Light-sensitive sheets, a cover sheet and a treating solution to be used for photographic materials for color diffusion transfer were prepared, as described below.

Light-Sensitive Sheets

The following layers were coated consecutively on a transparent polyethylene terephthalate support having been coated with a subbing layer, to form Light-Sensitive Sheets Nos. 1 through 7.

(1) Image-receiving layer containing polymeric mordant ($6.6\times10^{-3}$ equivalent (quaternary salt part)/$m^2$) and gelatin (3.0 g/$m^2$).

The above-described Compounds Nos. (1), (3), (9) and (15) were used as the polymeric mordants of the present invention, and the following Compounds (a), (b) and (c) were used as comparative mordants for Sample Nos. 1 through 7, respectively.

Comparative Mordant (a)

-continued

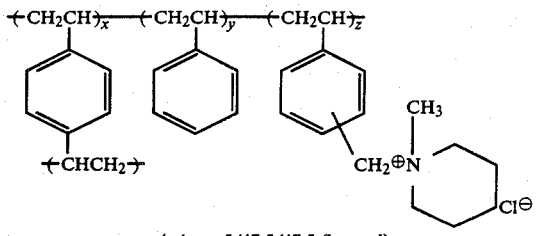

x/y/z = 5/47.5/47.5 (by mol)

-continued x/z = 5/95 (by mol)

(2) White reflective layer containing titanium dioxide (20 g/m$^2$) and gelatin (2.0 g/m$^2$).

(3) Light-shielding layer containing carbon black (2.0 g/m$^2$) and gelatin (1.5 g/m$^2$).

(4) Layer containing the following cyan dye-releasing redox compound (0.44 g/m$^2$), tricyclohexyl phosphate (0.09 g/m$^2$), 2,5-di-t-pentadecylhydroquinone (0.008 g/m$^2$) and gelatin (0.8 g/m$^2$).

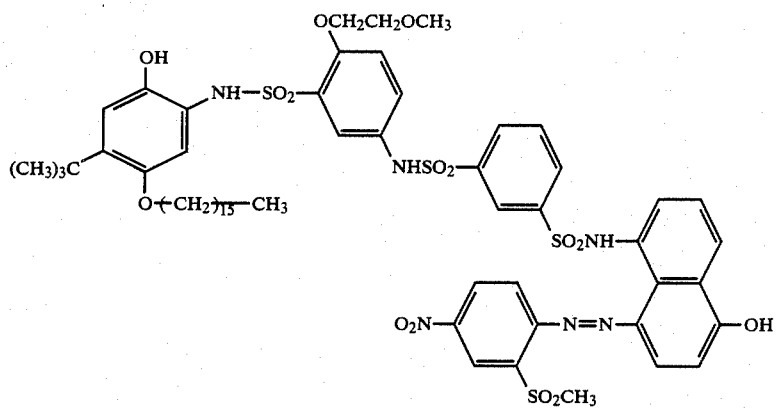

(5) Red-sensitive emulsion layer containing red-sensitive internal latent image type direct positive silver emulsion (1.03 g of silver/m$^2$), gelatin (1.2 g/m$^2$), the following nucleus-forming agent (0.04 g/m$^2$) and 2-sulfo-5-n-pentadecylhydroquinone sodium salt (0.13 g/m$^2$).

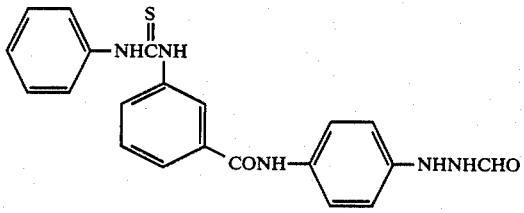

(6) Stain inhibitor layer containing gelatin (0.8 g/m$^2$), 2,5-di-t-pentadecylhydroquinone (1.0 g/m$^2$) and polymethyl methacrylate (1.0 g/m$^2$)

(7) Layer containing the following magenta dye-releasing redox compound (0.40 g/m$^2$), tricyclohexyl phosphate (0.08 g/m$^2$) and gelatin (0.9 g/m$^2$).

Comparative Mordant (b)

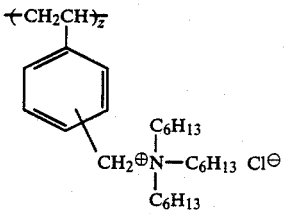

z = 100 (homopolymer)

Comparative Mordant (c)

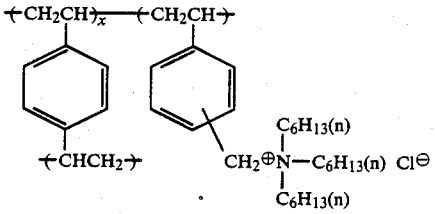

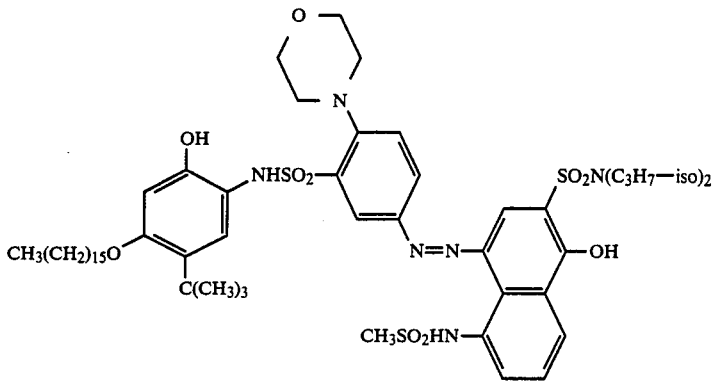

(8) Layer containing green-sensitive internal latent image type direct reversal silver bromide emulsion (0.82 g of silver/m$^2$), gelatin (0.9 g/m$^2$), the same nucleus-forming agent as the layer (5) (0.03 g/m$^2$) and 2-sulfo-5-n-pentadecylhydroquinone sodium salt (0.08 g/m$^2$).

(9) The same layer as the layer (6).

(10) Layer containing the following yellow dye-releasing redox compound (0.53 g/m$^2$), tricyclohexyl phosphate (0.13 g/m$^2$), 2,5-di-t-pentadecylhydroquinone (0.014 g/m$^2$) and gelatin (0.7 g/m$^2$).

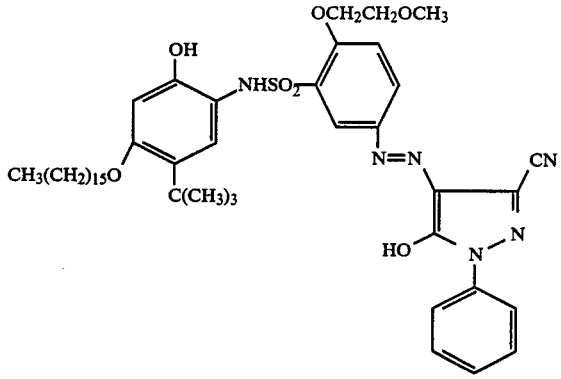

(11) Blue-sensitive emulsion layer containing blue-sensitive internal latent image type direct positive silver bromide emulsion (1.09 g of silver/m$^2$), gelatin (1.1 g/m$^2$), the same nucleus-forming agent as the layer (5) (0.04 mg/m$^2$) and 2-sulfo-5-n-pentadecylhydroquinone sodium salt (0.07 g/m$^2$).

(12) Protective layer containing gelatin (0.5 g/m$^2$), polymethyl methacrylate latex (0.06 g/m$^2$) and triacryloyltriazine (as hardener) (0.02 g/m$^2$).

Constitution of Cover Sheet

The following layers (1') through (3') were provided on a transparent polyethylene terephthalate support, in the order listed, to obtain a cover sheet.

(1') Layer containing a copolymer (22 g/m$^2$) comprising acrylic acid and butyl acrylate (80/20 by weight) and 1,4-bis(2,3-epoxypropoxy)butane (0.44 g/m$^2$).

(2') Layer containing acetyl cellulose (which yields 39.4 g of acetyl group by hydrolysis of 100 g of the acetyl cellulose (acetylation degree: about 50%)) (3.8 g/m$^2$), a methanol ring cleaved product (0.23 g/m$^2$) of a copolymer (molecular weight: about 50,000) comprising styrene and maleic anhydride (60/40 by weight), and 5-(2-cyano-1-methylethylthio)-1-phenyltetrazole (0.154 g/m$^2$).

(3') Layer comprising a combination of (a) a copolymer latex composed of styrene/n-butyl acrylate/acrylic acid/N-methylol acrylamide (49.7/42.3/3/5 by weight) and (b) a copolymer latex composed of methyl methacrylate/acrylic acid/N-methyl acrylamide (93/4/3 by weight), in which the solid content ratio of (a) to (b) is 6/4, having a thickness of 2 μm.

Composition of Treating Solution

| | |
|---|---|
| 1-p-Tolyl-4-hydroxymethyl-4-methyl-3-pyrazolidone | 6.9 g |
| Methylhydroquinone | 0.3 g |
| 5-Methylbenzotriazole | 3.5 g |
| Sodium Sulfite (anhydride) | 0.2 g |
| Carboxymethyl Cellulose Sodium Salt | 58 g |
| Potassium Hydroxide (28% aq. soln.) | 200 cc |
| Benzyl Alcohol | 1.5 cc |
| Carbon Black | 150 g |
| Water | 685 cc |

Each of the above Light-Sensitive Sheets Nos. (1) through (7) was exposed to light through a continuous wedge and then passed between a pair or pressure rollers whereby the treating solution was spread between the light-sensitive sheet and the cover sheet in a thickness of 80 μm.

60 Minutes after the processing with the treating solution being spread, the density was measured in the form of a monosheet. This is the density in a wet state. Immediately after this, the cover sheet was peeled off from the interface between the cover sheet and the treating solution, and the light-sensitive sheet was left at room temperature for about 5 to 15 minutes, and thus the sheet was completely dried. The density of the sample sheet was measured, which is the density in a dry state. The results are set forth in the following Table 1.

In this Table 1, the difference between the dry density and the wet density is the measure of the cloud of the film. In other words, the density in the dry state is considered the genuine density which corresponds to the amount of the mordanted dye, whereas the density in the wet state apparently decreases because of the cloud in the case when the film becomes cloudy in the wet state.

Accordingly, it is preferred that the difference between the dry density and the wet density is smaller and thus the cloud is less. It has separately been proved that the difference of Dmax falling within the range of 0.12 or less is free from any visual and substantial problem.

Still 15 minutes after the above measurement of the density in a wet state, the density of the sample with the cover sheet being not peeled off was measured. The density was proved to be almost the same as that of the sample as measured after 60 minutes, the difference therebetween being within 0.02 or less. In the case that the sample after being peeled off and dried was dipped in water, the density of the dipped sample became lower, as being almost the same as that of the wet density (of monosheet).

Next, each of the Light-Sensitive Sheets Nos. (1) through (7) was exposed to light through a wedge for a resolving powder test where the frequency was varied, and then the treating solution was spread. After 1 hour from spreading, the density was measured with a microdensitometer. The space frequency whereupon the MTF value of the magenta color was 0.5 was obtained from the data of the measurement, and the results given in Table 1. Afterwards, each sample was preserved under the condition of 50° C. and 80% RH (relative humidity) for 3 days, and the MTF value was again obtained in each sample.

MTF means "Modulor Transfer Function", and is described in detail in *The Theory of Photographic Process*, 4th Ed., T. H. James ed., published by Macmillan Publishing Co., New York, 1977, pp. 604–607.

MTF is a measure of the resolving power (sharpness), and a photographic material capable of faithfully reproducing fine lines has a higher MTF value. In the case of diffusion transfer photographic materials, the mordantability between the dye and the mordant is the main factor for the determination of the sharpness, and in particular, it has already been noted that the deterioration of the sharpness with the lapse of time after the photographic processing is less in the light-sensitive element of higher mordantability, which means that the light-sensitive element of higher mordantability is better.

TABLE 1

| Sample No. | Mordant | Cloud $D_{max}^G$ Wet State | Cloud $D_{max}^G$ Dry State | Cloud Difference | Sharpness* After 1 Hour | Sharpness* After Preservation at 50° C., 80% RH for 3 Days |
|---|---|---|---|---|---|---|
| 1 | Polymeric Mordant (1) of the present invention | 2.10 | 2.20 | 0.10 | 3.1 | 3.0 |
| 2 | Polymeric Mordant (3) of the present invention | 2.10 | 2.21 | 0.11 | 3.2 | 3.1 |
| 3 | Polymeric Mordant (9) of the present invention | 2.10 | 2.19 | 0.09 | 3.1 | 2.9 |
| 4 | Polymeric Mordant (15) of the present invention | 2.09 | 2.18 | 0.09 | 3.2 | 2.9 |
| 5 | Comparative Mordant (a) | 2.03 | 2.14 | 0.11 | 3.1 | 2.2 |
| 6 | Comparative Mordant (b) | 1.79 | 2.18 | 0.39 | 3.1 | 2.9 |
| 7 | Comparative Mordant (c) | 1.86 | 2.20 | 0.34 | 3.1 | 2.9 |

Sharpness*: In the case the value of the frequency whereupon the MTF value of the G density was 0.5 or higher, the sharpness of the image was higher or better.

Table 1 proves that the photographic materials containing the mordant of the present invention have less film cloud and higher sharpness and are therefore quite excellent in quality, whereas those containing a conventional mordant have a significant film cloud in a wet state if they have high sharpness, or on the contrary have lower sharpness if they have less film cloud.

While the invention has been described in detail and with reference to specific embodiments thereof, it will be apparent to one skilled in the art that various changes and modifications can be made therein without departing from the spirit and scope thereof.

What is claimed is:

1. A photographic element comprising at least one layer containing a polymeric mordant represented by formula (I)

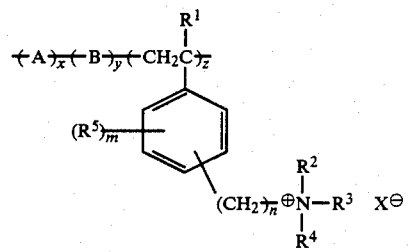

(I)

wherein

A represents a repeating unit derived from a copolymerizable monomer having at least two ethylenically unsaturated groups;

B represents a repeating unit derived from a copolymerizable ethylenically unsaturated monomer other than the repeating unit of A and the repeating unit having the copolymerization ratio of z;

$R^1$ represents a hydrogen atom or a lower alkyl group;

$R^2$, $R^3$, and $R^4$ each represents an unsubstituted or substituted alkyl or aralkyl group, or two or more of $R^2$, $R^3$, and $R^4$ are bonded to form a cyclic structure together with the adjacent nitrogen atom, and the total number of carbon atoms of $R^2$, $R^3$ and $R^4$ is 12 or more;

$R^5$ represents an unsubstituted or substituted alkyl, alkoxy, or acylamino group having 1 to 20 carbon atoms, or a halogen atom;

m is 0, 1, or 2, and n is an integer of from 1 to 12;

$X^{\ominus}$ represents an anion; and x is from 30 to 80 mol%, y is from 0 to 60 mol%, and z is from 10 to 70 mol%.

2. A photographic element as claimed in claim 1, wherein said photographic element comprises a support having provided thereon at least one light-sensitive silver halide emulsion layer and at least one layer containing said polymeric mordant.

3. A photographic element as in claim 1, wherein A in formula (I) represents a repeating unit derived from a monomer selected from the group consisting of divinylbenzene and ethylene glycol dimethacrylate.

4. A photographic element as in claim 1, wherein B in formula (I) represents a repeating unit derived from a monomer selected from the group consisting of styrene, methyl methacrylate, and acrylonitrile.

5. A photographic element as in claim 1, wherein $R^1$ in formula (I) represents a hydrogen atom or an alkyl group having from 1 to 6 carbon atoms.

6. A photographic element as in claim 5, wherein $R^1$ in formula (I) represents a hydrogen atom or a methyl group.

7. A photographic element as in claim 1, wherein $R^2$, $R^3$, and $R^4$ in formula (I) each represents an unsubstituted or substituted alkyl group having from 1 to about 20 carbon atoms, or an unsubstituted or substituted aralkyl group having from 7 to about 20 carbon atoms.

8. A photographic element as in claim 7, wherein $R^2$, $R^3$, and $R^4$ in formula (I) each represents an unsubstituted alkyl group having from 1 to 10 carbon atoms.

9. A photographic element as in claim 7, wherein $R^2$, $R^3$, and $R^4$ in formula (I) each represents an unsubstituted or substituted aralkyl group having from 7 to 14 carbon atoms.

10. A photographic element as in claim 1, wherein $R^5$ in formula (I) represents a methoxy group, an ethoxy group, a butoxy group, a hexyloxy group, an octyloxy group, a benzyloxy group, an acetamido group, a propionamido group, or a benzamido group.

11. A photographic element as in claim 1, wherein m in formula (I) is 0, and n in formula (I) is 1.

12. A photographic element as in claim 1, wherein $X^{\ominus}$ in formula (I) represents a halogen ion, an alkylsulfuric acid ion, an alkyl- or arylsulfonic acid ion, an acetic acid ion, or a sulfuric acid ion.

13. A photographic element as in claim 12, wherein $X^{\ominus}$ represents a chlorine ion.

14. A photographic element as in claim 1, wherein x in formula (I) is from 30 to 70 mol%, y in formula (I) is from 0 to 30 mol%, and z in formula (I) is from 30 to 70 mol%.

15. A photographic element as in claim 1, wherein the polymeric mordant is present in an amount of from about 0.5 to 15 g/m$^2$.

16. A photographic element as in claim 15, wherein the polymeric mordant is present in an amount of from 1 to 10 g/m$^2$.

17. A photographic film unit comprising (a) a light-sensitive element, (b) an image-receiving element, (c) an element for releasing an alkaline treating composition, and (d) at least one support, wherein said image-receiving element contains a polymeric mordant represented by formula (I)

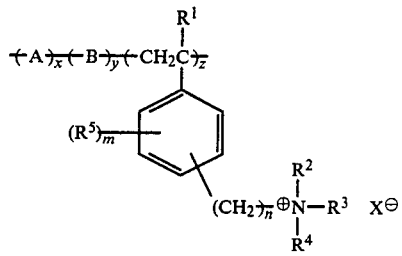

(I)

wherein

A represents a repeating unit derived from a copolymerizable monomer having at least two ethylenically unsaturated groups;

B represents a repeating unit derived from a copolymerizable ethylenically unsaturated monomer other than the repeating unit of A and the repeating unit having the copolymerization ratio of z;

$R^1$ represents a hydrogen atom or a lower alkyl group;

$R^2$, $R^3$, and $R^4$ each represents an unsubstituted or substituted alkyl or aralkyl group, or two or more of $R^2$, $R^3$, and $R^4$ are bonded to form a cyclic structure together with the adjacent nitrogen atom, and the total number of carbon atoms of $R^2$, $R^3$, and $R^4$ is 12 or more;

$R^5$ represents an unsubstituted or substituted alkyl, alkoxy, or acylamino group having 1 to 20 carbon atoms, or a halogen atom;

m is 0, 1 or 2, and n is an integer of from 1 to 12;

$X^{\ominus}$ represents an anion; and x is from 30 to 80 mol%, y is from 0 to 60 mol%, and z is from 10 to 70 mol%.

18. A photographic film unit as in claim 17, wherein said support (d), said image-receiving element (b), and said light-sensitive element (a) form an integral unit.

* * * * *